US009801429B2

(12) United States Patent
Uchikawa et al.

(10) Patent No.: US 9,801,429 B2
(45) Date of Patent: Oct. 31, 2017

(54) INSTEP COVER AND SHOE UPPER

(71) Applicant: SHIMA SEIKI MFG., LTD., Wakayama-shi, Wakayama (JP)

(72) Inventors: Yoshihisa Uchikawa, Wakayama (JP); Masamitsu Ikenaka, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 0 days.

(21) Appl. No.: 15/029,054

(22) PCT Filed: Oct. 9, 2014

(86) PCT No.: PCT/JP2014/077107
§ 371 (c)(1),
(2) Date: Apr. 13, 2016

(87) PCT Pub. No.: WO2015/056633
PCT Pub. Date: Apr. 23, 2015

(65) Prior Publication Data

US 2016/0255913 A1 Sep. 8, 2016

(30) Foreign Application Priority Data

Oct. 15, 2013 (JP) ..... 2013-214788

(51) Int. Cl.
*A43C 11/00* (2006.01)
*A43C 11/22* (2006.01)
(Continued)

(52) U.S. Cl.
CPC ..... *A43B 23/0245* (2013.01); *A43B 1/04* (2013.01); *A43B 23/0205* (2013.01);
(Continued)

(58) Field of Classification Search
CPC ... A43B 23/0245; A43B 23/0225; A43C 1/00; A43C 1/003; A43C 1/004; A43C 1/006; A43C 5/00
(Continued)

(56) References Cited

U.S. PATENT DOCUMENTS 712,003 A * 10/1902 Payne ..... A43C 1/04 24/714.7
1,196,216 A * 8/1916 Doredant et al. .... A43C 11/008 24/370
(Continued)

FOREIGN PATENT DOCUMENTS

EP 3 056 106 A1 8/2016
JP 3439549 B2 6/2003
(Continued)

OTHER PUBLICATIONS

International Search Report cited in PCT/JP2014/077107, dated Jan. 13, 2015, 1 page.
(Continued)

*Primary Examiner* — Jila A Mohandesi
(74) *Attorney, Agent, or Firm* — Rothwell, Figg, Ernst & Manbeck, P.C.

(57) ABSTRACT

There is provided an instep cover in which various designs can be provided on a side surface portion of the instep cover even when a shoelace holding section is provided, and a shoe upper including the instep cover.
In a shoe upper (100) configuring a shoe, an instep cover (1) that covers a portion on an instep side of a wearer includes a slit (5S) extending from a foot insertion opening for the wearer to insert a foot toward a toe, and a shoelace holding section (4) that holds a shoelace for adjusting a spacing of the slit (5S). The shoelace holding section (4) includes a holding unit (4U) configured by a hole (4*h*) formed in a slit edge region (11) that shapes the slit (5S), and an annular
(Continued)

strap (4*s*) being formed to an annular shape by connecting one end and the other end of a lace-like body to the slit edge region (11) and having a length that can be pulled out from the hole (4*h*) when an intermediate portion of the lace-like body is brought to a position of the hole (4*h*).

13 Claims, 3 Drawing Sheets

(51) Int. Cl.

| | |
|---|---|
| ***A43B 23/02*** | (2006.01) |
| ***A43B 1/04*** | (2006.01) |
| ***A43C 1/00*** | (2006.01) |
| ***A43C 1/04*** | (2006.01) |
| ***A43C 5/00*** | (2006.01) |

(52) U.S. Cl.
CPC ..... *A43B 23/0275* (2013.01); *A43C 1/00* (2013.01); *A43C 1/04* (2013.01); *A43C 5/00* (2013.01)

(58) Field of Classification Search
USPC ..... 36/50.1
See application file for complete search history.

(56) References Cited

U.S. PATENT DOCUMENTS

| | | | | | |
|---|---|---|---|---|---|
| 1,466,078 | A * | 8/1923 | Washburn | A43C 1/00 | 24/712 |
| 1,995,243 | A * | 3/1935 | Clarke | A43C 1/00 | 24/713.3 |
| 2,239,325 | A * | 4/1941 | Hills | A43C 5/00 | 24/715.2 |
| 2,369,254 | A * | 2/1945 | Roman | A43C 1/04 | 36/50.1 |
| 2,867,021 | A * | 1/1959 | Wittl | A41F 1/00 | 24/713.3 |
| 2,867,878 | A * | 1/1959 | Sundback | A44B 19/403 | 24/390 |
| 3,112,545 | A * | 12/1963 | Williams | A43C 11/12 | 24/390 |
| 4,507,878 | A * | 4/1985 | Semouha | A43C 11/008 | 24/68 SK |
| 4,974,299 | A * | 12/1990 | Moon | A43C 1/04 | 24/714.6 |
| 5,040,274 | A * | 8/1991 | Keech | A43C 11/008 | 24/381 |
| 5,230,171 | A * | 7/1993 | Cardaropoli | A43C 11/14 | 36/50.1 |
| 5,557,864 | A * | 9/1996 | Marks | A43C 11/00 | 24/306 |
| 5,701,688 | A * | 12/1997 | Crowley | A43B 23/26 | 36/101 |
| 5,755,044 | A | 5/1998 | Veylupek | | |
| 6,119,372 | A * | 9/2000 | Okajima | A43B 5/04 | 36/117.1 |
| 6,240,657 | B1 * | 6/2001 | Weber | A43B 1/0072 | 24/714.8 |
| 8,544,192 | B2 * | 10/2013 | Hope | A43B 23/024 | 36/45 |
| 2004/0181972 | A1 * | 9/2004 | Csorba | A43B 7/1495 | 36/50.1 |
| 2012/0216422 | A1 | 8/2012 | Ikezawa et al. | | |

FOREIGN PATENT DOCUMENTS

| | | |
|---|---|---|
| JP | 2012196488 A | 10/2012 |
| JP | 5150377 B2 | 12/2012 |

OTHER PUBLICATIONS

Extended Search Report dated Jul. 12, 2017 cited in European Application No. 14853224.5, 7 pages.

* cited by examiner

INSTEP COVER AND SHOE UPPER

CROSS REFERENCE TO RELATED APPLICATION

This application is a 35 U.S.C. 371 National Phase Entry Application from PCT/JP2014/077107, filed Oct. 9, 2014, which claims the benefit of Japanese Patent Application No. 2013-214788 filed on Oct. 15, 2013, the disclosures of which are incorporated by reference in their entirety.

TECHNICAL FIELD

The present invention relates to an instep cover configuring a part of a shoe upper, and a shoe upper including the instep cover.

BACKGROUND ART

A shoe includes a shoe upper with a sole cover that covers a sole of a wearer and an instep cover that covers a portion on an instep side of the wearer. In outdoor shoes, an outer sole made of synthetic resin and the like is attached to the sole cover of the shoe upper. In recent years, attempts have been made to configure the instep cover, of the instep cover and the sole cover configuring the shoe upper, with one knitted fabric to produce the shoes with high productivity. For example, Patent Document 1 discloses a technique of forming the instep cover in a planarly developed state with one knitted fabric, and joining such instep cover to an outer sole made of synthetic resin and the like, along with a sole cover prepared separately from the instep cover to complete the shoe.

In the shoe in which a shoelace is provided at a position of a slit extending from a foot insertion opening toward the toe of the shoe, a plurality of eyelets is generally provided at the positions of a slit edge region as a shoelace holding section for holding the shoelace. In Patent Document 1, on the other hand, an instep cover including a shoelace holding section with a plurality of holding units arranged in place of the eyelets is disclosed. Each holding unit is configured by a tubular portion (referred to as channel in cited document 1) arranged at a side surface portion of the instep cover, and a lace-like body (referred to as lace element in cited document 1) to be inserted and fixed to the tubular portion, where a shoelace is passed through a loop formed by the lace-like body projecting out toward the slit side from the tubular portion.

PRIOR ART DOCUMENT

Patent Document

[Patent Document 1] Unexamined Japanese Patent Publication No. 2012-196488

SUMMARY OF THE INVENTION

Problems to be Solved by the Invention

The instep cover of Patent Document 1 has a problem in that the design is limited. This is because the tubular portion configuring the holding unit needs to be formed at the side surface portion of the instep cover of Patent Document 1. In particular, as the preference of the design is becoming more diversified in recent years, the configuration of the cited document 1 cannot respond to the request of such diversification.

Furthermore, the instep cover of Patent Document 1 has a problem of poor productivity. In the instep cover of Patent Document 1, the tubular portion is formed at the side surface portion of the instep cover, and thereafter, the lace-like body formed separately from the instep cover needs to be inserted and fixed to the tubular portion.

The present invention has been made in light of the above circumstances, and an object of the present invention is to provide an instep cover in which various designs can be provided on the side surface portion of the instep cover even when the shoelace holding section is provided, and a shoe upper. Another object of the present invention is to provide an instep cover including a shoelace holding section excelling in productivity, and a shoe upper.

Means for Solving the Problems

An aspect of the present invention relates to an instep cover that covers a portion on an instep side of a wearer of a shoe upper configuring a shoe, the instep cover including a slit extending from a foot insertion opening for the wearer to insert a foot toward a toe, and a shoelace holding section that holds a shoelace for adjusting a spacing of the slit. The shoelace holding section arranged in the instep cover of the present invention includes a holding unit configured by a hole formed in a slit edge region that shapes the slit, and an annular strap being formed by connecting one end and the other end of a lace-like body to the slit edge region and having a length of being pulled out from the hole when an intermediate portion of the lace-like body is brought to a position of the hole.

According to one aspect of the instep cover of the present invention, the shoelace holding section includes a first holding unit and a second holding unit used as a pair with the first holding unit, with a portion on a right side of a center line that divides the slit to right and left being a right side edge region and a portion on a left side being a left side edge region in the slit edge region of the instep cover. In such aspect, the first holding unit is configured by a right side hole formed in the right side edge region and a left side strap connecting to the left side edge region, and the second holding unit is configured by a left side hole formed in the left side edge region and a right side strap connecting to the right side edge region. A position of the right side hole in a length direction of the instep cover is between a toe side connecting portion and a heel side connecting portion of the lace-like body configuring the right side strap, and a position of the left side hole in the length direction of the instep cover is between a toe side connecting portion and a heel side connecting portion of the lace-like body configuring the left side strap.

An aspect of the present invention relates to a shoe upper including the instep cover of the present invention, a sole cover that covers a sole of a wearer, and a shoelace for adjusting a spacing of the slit formed in the instep cover; wherein an intermediate portion of the strap is passed through the hole while being folded in half, and the shoelace is held in a state passed through a lace passing hole formed by the intermediate portion pulled out from the hole.

Effect of the Invention

According to the configuration of the present invention, various designs can be provided on the side surface portion of the instep cover even when the shoelace holding section that holds the shoelace is arranged. This is because the hole and the strap configuring the holding unit of the shoelace holding section are both arranged in the slit edge region. Furthermore, as will be described in the embodiments hereinafter, the hole and the strap arranged in the slit edge region can be integrally formed in the instep cover by the knitting with the flat knitting machine and the like, whereby the instep cover of the present invention and the shoe upper using the same have excellent productivity.

According to the configuration of the present invention including the first holding unit and the second holding unit used as a pair, the tightening force caused by the shoelace can be substantially equally acted on the slit edge region of the instep cover. As a result, the fitting property of the instep cover with respect to the foot of the wearer can be enhanced. Moreover, as the tightening force can be suppressed from unevenly acting on the instep cover, the shoelace holding section and the like can be avoided from being damaged in a short period of time.

MODE FOR CARRYING OUT THE INVENTION

Embodiments of a shoe upper, and an instep cover configuring a part of the shoe upper of the present invention will be described below based on the drawings.

First Embodiment

<<Overall Configuration>>

Figure 1:
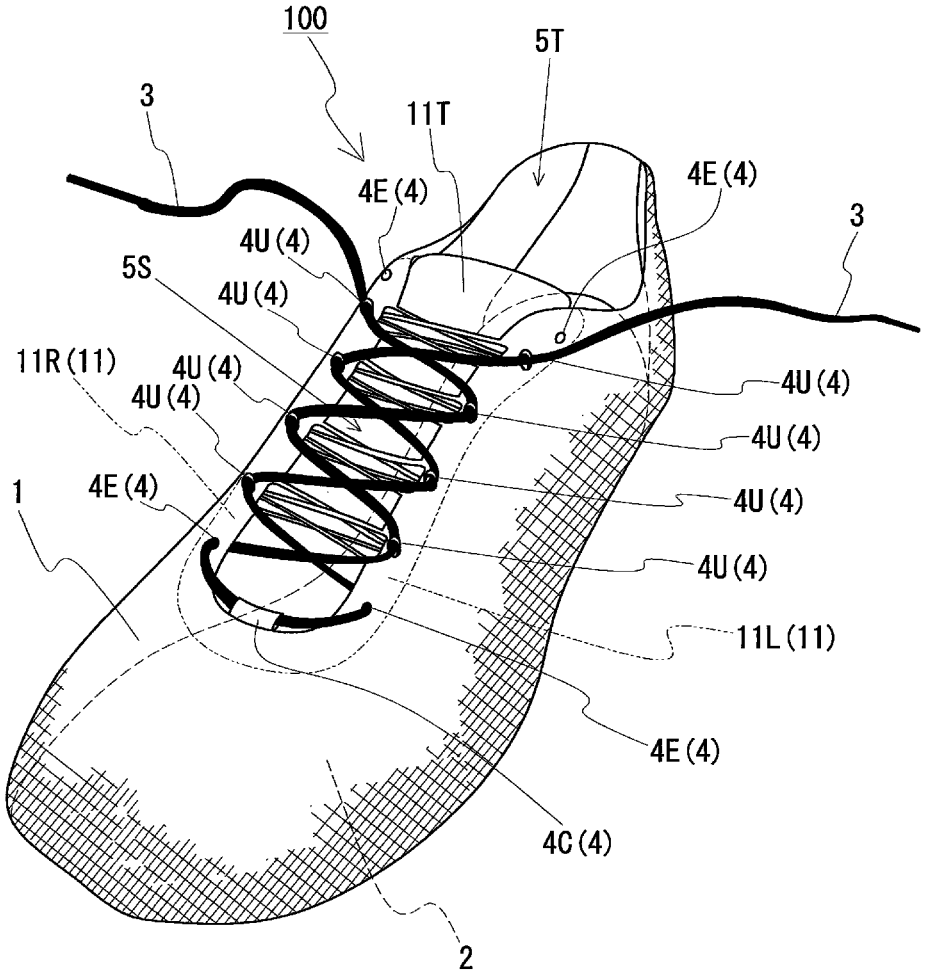
FIG. 1 is a schematic upper perspective view of a shoe upper.

A shoe upper 100 shown in FIG. 1 includes an instep cover 1 that covers a portion on an instep side of a wearer, and a sole cover 2 that covers a portion of a sole. The instep cover 1 includes a foot insertion opening 5T, which becomes the insertion opening for the foot, and a slit 5S extending from the foot insertion opening 5T toward the toe. The shoe upper 100 may be used as it is as a shoe, or an outer sole (not shown) made of resin and the like may be attached to the outer side (bottom side) of the sole cover 2 to complete the shoe.

The shoe upper 100 is a shoe upper of a type in which the spacing of the slit 5S can be adjusted with a shoelace 3 to enhance the fitting property of the shoe upper 100 (instep cover 1) with respect to the foot of the wearer. A configuration of a shoelace holding section 4 for holding the shoelace 3 is one of the most characteristic portion of the shoe upper 100 (instep cover 1) in the present embodiment. Each configuration of the shoe upper 100 will be hereinafter described in detail.

<<Instep Cover>>

The instep cover 1 in the present embodiment is a seamless knitted fabric knitted separately from the sole cover 2. A knitting yarn including a heat fusible yarn is preferably used for such knitting. The instep cover 1 may be a seamless knitted fabric knitted integrally with the sole cover 2.

The slit 5S leading to the foot insertion opening 5T is formed in the instep cover 1 as described above. A post-attached tongue 11T is arranged at the position of the slit 5S (tongue 11T can be knitted integrally with the instep cover 1). A shoelace holding section 4 having a novel configuration for holding the shoelace 3 is formed at a part of the instep cover 1, such portion being a slit edge region 11 including a rim of the slit 5S. The slit edge region 11 is a region of a predetermined width (for example, width of smaller than or equal to 2.0 cm) including the rim of the slit 5S.

Figure 2:
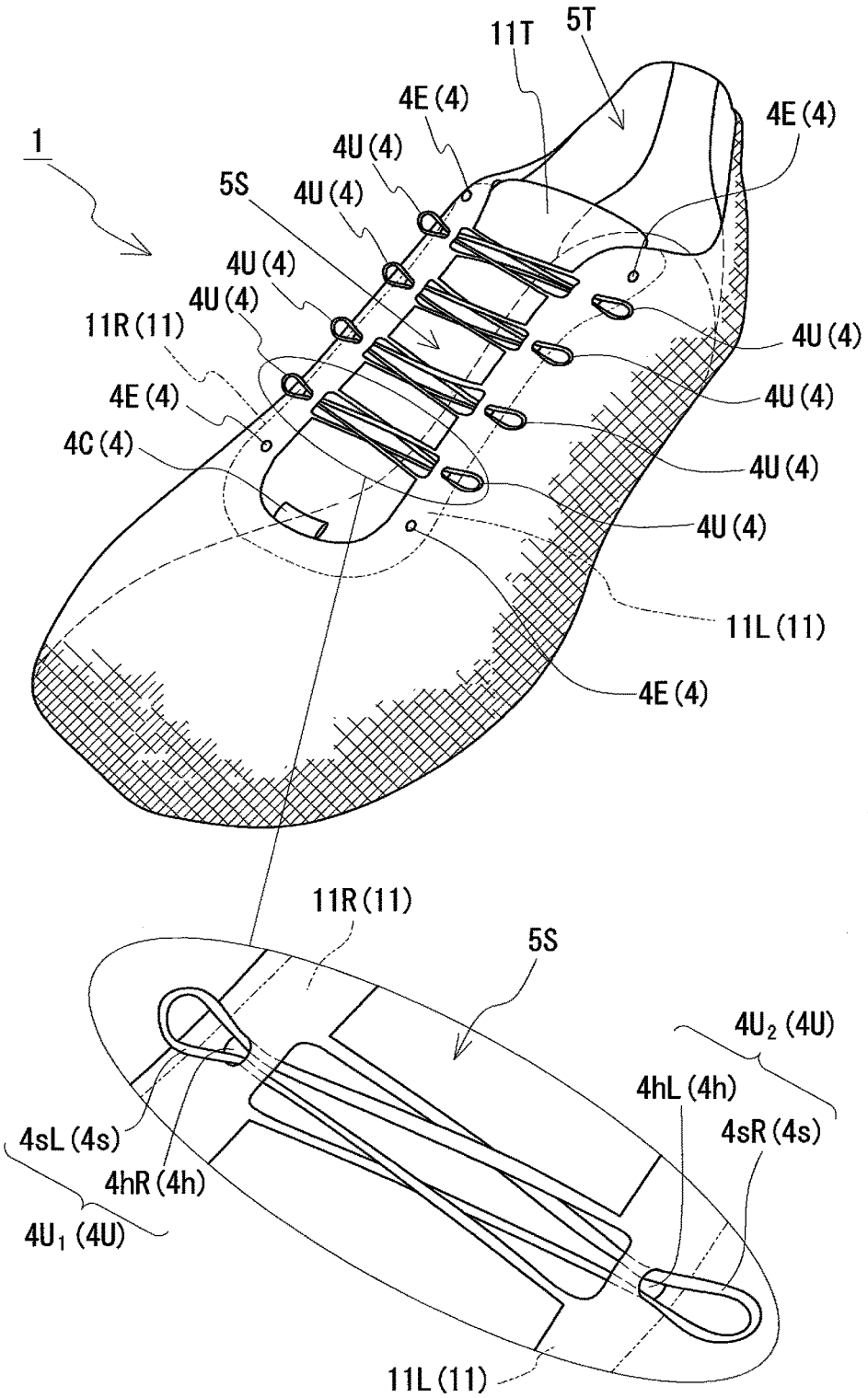
FIG. 2 is a schematic upper perspective view of an instep cover of the shoe upper.

As shown in FIGS. 1 and 2, the shoelace holding section 4 is configured by a tube portion 4C, a plurality of eyelet holes 4E, and a plurality of holding units 4U. The tube portion 4C is arranged at a cut end of the slit 5S, and holds a central part of the shoelace 3 (see FIG. 1). A total of four eyelet holes 4E are arranged, one at a position in the vicinity of the tube portion 4C and one at a position in the vicinity of the foot insertion opening 5T in both a right side edge region 11R and a left side edge region 11L, with a portion on a right side of a center line dividing the slit 5*s* to the right and left in the slit edge region 11 being the right side edge region 11R and a portion on a left side being the left side edge region 11L. The position of the eyelet hole 4E in the slit edge region 11 and the number of eyelet holes 4E are not particularly limited.

As shown in FIG. 2, the holding unit 4U is configured by a hole 4*h* formed in the slit edge region 11, and a strap 4*s* formed by connecting one end and the other end of the lace-like body to the slit edge region 11 and used as a pair with the hole 4*h*. The strap 4*s* has a length that can be pulled out from the hole 4*h* when an intermediate portion of the lace-like body configuring the strap 4*s* is brought to the position of the hole 4*h*. Here, the holding unit 4U of the present embodiment can be divided to a first holding unit $4U_1$, and a second holding unit $4U_2$ used as a pair with the first holding unit $4U_1$, as shown with a circled enlarged view. The first holding unit $4U_1$ is configured by a right side hole 4*h*R formed in the right side edge region 11R, and a left side strap 4*s*L connecting to the left side edge region 11L. The second holding unit $4U_2$, on the other hand, is configured by a left side hole 4*h*L formed in the left side edge region 11L, and a right side strap 4*s*R connecting to the right side edge region 11R. Both the straps 4*s*R, 4*s*L have a length of traversing the slit 5S and reaching the holes 4*h*L, 4*h*R.

The right side hole 4*h*R of the first holding unit $4U_1$ in a length direction of the instep cover 1 is arranged between a toe side connecting portion and a heel side connecting portion of the lace-like body configuring the right side strap 4*s*R of the second holding unit $4U_2$. The position of the left side hole 4*h*L of the second holding unit $4U_2$ in a length direction of the instep cover 1 is arranged between a toe side connecting portion and a heel side connecting portion of the lace-like body configuring the left side strap 4*s*L of the first holding unit $4U_1$. That is, the first holding unit $4U_1$ and the second holding unit $4U_2$ are lined in a width direction of the instep cover 1 at substantially the same position in the length direction of the instep cover 1. The holding units $4U_1$, $4U_2$ in such position relationship are arranged in a total of four sets in the present embodiment. The number of sets of the holding units $4U_1$, $4U_2$, is not, of course, particularly limited. The length of each strap 4*s*R, 4*s*L lined from the toe toward the heel may be the same or may be different. Furthermore, the position from the rim of the slit 5S of each hole 4*h*R, 4*h*L lined from the toe toward the heel may be the same or may be different.

The intermediate portion of the left side strap 4*s*L configuring the first holding unit $4U_1$ described above is passed through the right side hole 4*h*R configuring the first holding unit $4U_1$ while being folded in half, when the shoelace 3 (see FIG. 1) is provided in the instep cover 1. The intermediate portion of the right side strap 4*s*R configuring the second holding unit $4U_2$ is also passed through the left side hole 4*h*L configuring the second holding unit $4U_2$ while being folded in half, when the shoelace 3 (see FIG. 1) is provided in the instep cover 1. As a result, a right side lace passing hole is formed by the intermediate portion pulled out from the right side hole 4*h*R, and a left side lace passing hole is formed by the intermediate portion pulled out from the left side hole 4*h*L. As shown in FIG. 1, the shoelace 3 for adjusting the spacing of the slit 5S can be arranged in the shoelace holding section 4 of the shoe upper 100 (instep cover 1) by passing the shoelace 3 through the right and left lace passing holes, the tube portion 4C, and the eyelet holes 4E.

The manner of passing the shoelace 3 is not limited to the manner of passing shown in FIG. 1. In FIG. 1, the straps 4*s*L, 4*s*R are passed from the back side toward the front side of the holes 4*h*R, 4*h*L, but may be passed from the front side toward the back side. This is similar in second to fourth embodiments to be described later.

<<Sole Cover>>

The sole cover 2 configuring the shoe upper 100 shown in FIG. 1 is a knitted fabric knitted separately from the instep cover 1 described above. The sole cover 2 is preferably knitted using a knitting yarn exceling in strength more than the knitting yarn configuring the instep cover 1. The sole cover 2 does not need to be a knitted fabric, and for example, may be a woven fabric, a molded article made of resin and the like.

<<Effects>>

The shoe upper 100 of the present embodiment described above has a novel design not found in the past. Since the shoelace holding section 4 for holding the shoelace 3 is arranged in the slit edge region 11 and is not extended to the side surface portion of the shoe upper 100, the design of the side surface portion can be freely changed.

In the shoe upper 100 of the present embodiment, the holding unit 4U for holding the shoelace 3 can be formed by simply inserting the strap 4S, which is integrally arranged in the instep cover 1, through the hole 4*h*, which is similarly integrally arranged in the instep cover 1. That is, when forming the holding unit 4U, the trouble of separately preparing a member, the trouble of attaching the prepared member to the instep cover 1 are eliminated, whereby the shoe upper 100 of the present embodiment excels in productivity.

<<Method for Knitting Instep Cover>>

The instep cover 1 in the present embodiment can be knitted by using a flat knitting machine including at least a pair of a front and a back needle bed, in which stitches can be transferred between the front and back needle beds. One example of a knitting procedure of the instep cover 1 using a flat knitting machine including two needle beds will be hereinafter described based on a schematic view of a knitting procedure shown in FIG. 3.

Figure 3:
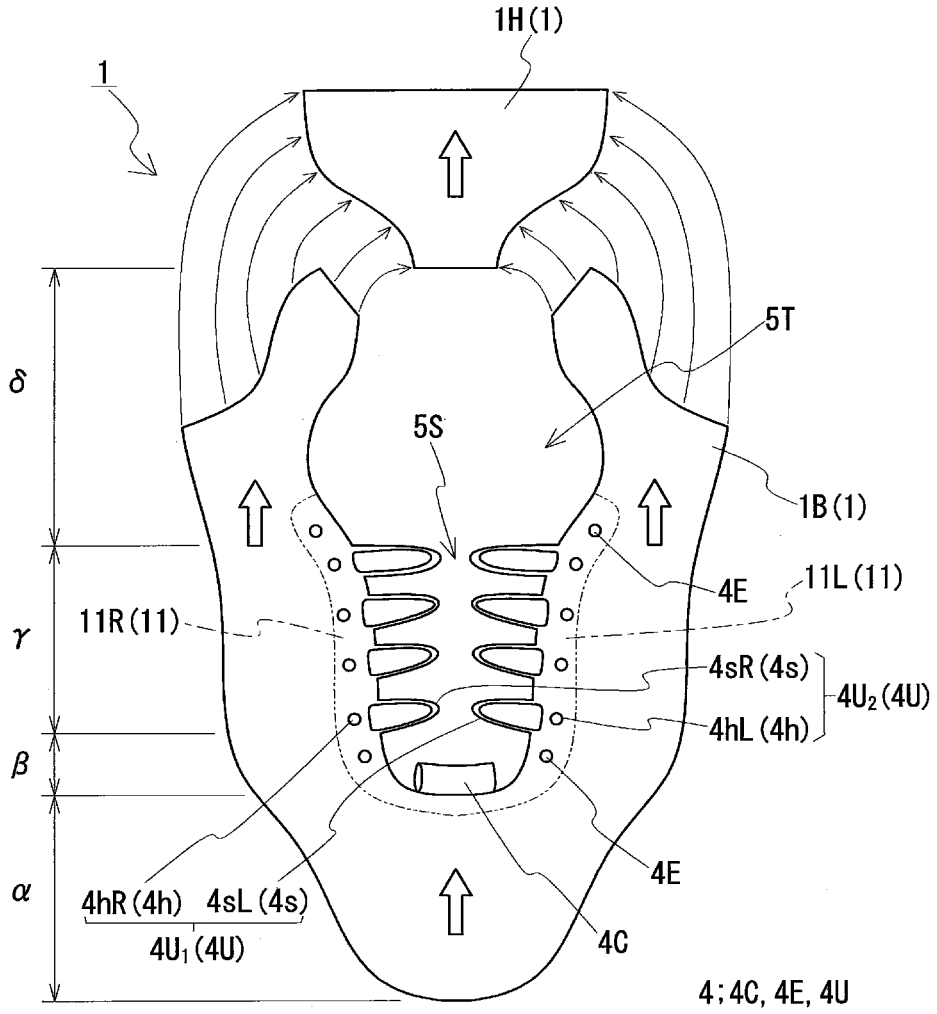
FIG. 3 is a schematic view showing a knitting procedure of the instep cover.

In the knitting procedure shown in FIG. 3, the instep cover 1 is knitted separately for a body section 1B and a heel cover section 1H. The heel cover section 1H is a section that covers a region from the Achilles' tendon to the heel of the wearer, and the body section 1B is the other sections. As shown with an outlined arrow in the figure, in the present embodiment, the body section 1B is knitted from the toe side toward the heel side, and then the heel cover section 1H is knitted from the upper end side (foot insertion opening 5T side) toward the lower end side (bottom side). The detailed description will be omitted, but the heel cover section 1H may be knitted from the lower end side toward the upper end side, and then the body section 1B may be knitted from the heel side toward the toe side.

In the present knitting procedure, the body section 1B is knitted from the toe side toward the heel side to complete the body section 1B. The knitting pattern and the knitting yarn may be partially changed in knitting the body section 1B. The body section 1B is divided into regions α to δ in a length direction of the instep cover 1, and knitted respectively. The left side portion and the right side portion of the body section 1B are knitted while being lined side by side on the left and right on the needle beds.

In the knitting of the region α, knitting is carried out from the toe of the instep cover 1 to the position of the cut end of the slit 5S. The portion of the region α can be knitted using one yarn feeder, or can also be knitted using a plurality of yarn feeders.

The portion of the region α is preferably a knitting pattern thicker than the plain knitting pattern (this is the same in the regions β to δ, to be described later, and the heel cover section 1H). The thick knitting pattern can be knitted through a knitting method that provides thickness to the knitting pattern using the front and back needle beds. Such knitting method is not particularly limited as long as it is a knitting method that uses the front and back needle beds. For example, the thick knitting pattern can be knitted by appropriately combining the knitting that uses the front and back needle beds such as rib knitting, tubular knitting and the like.

In the region β, the tube portion 4C is knitted at the position of the cut end of the slit 5S, and the right side portion and the left side portion of the instep cover 1 are knitted. The tube portion 4C may be formed, for example, by dividing the instep cover 1 to the front and back at the position of the cut end and knitting a knitted fabric portion on one of the divided portions, and thereafter connecting an end in a wale direction of the knitted fabric portion to the other divided portion.

The right side portion and the left side portion of the instep cover 1 are knitted using different yarn feeders. The right side portion and the left side portion, respectively, may be knitted using one yarn feeder, or may be knitted using a plurality of yarn feeders. Transfer, formation of double stitches and the like can be used to form the eyelet hole 4E provided in each of the right side portion and the left side portion.

In the region γ, the right side portion and the left side portion of the instep cover 1 are knitted, and the first holding unit $4U_1$ (4U) and the second holding unit $4U_2$ (4U) are formed. As already described above, the first holding unit $4U_1$ is configured by the right side hole 4*h*R formed in the right side edge region 11R and the left side strap 4*s*L connecting to the left side edge region 11L, and the second holding unit $4U_2$ is configured by the left side hole 4*h*L formed in the left side edge region 11L, and the right side strap 4*s*R connecting to the right side edge region 11R.

Upon knitting the region γ, the knitting of the lace-like body to become the right side strap 4*s*R is started following some of the stitches on the slit 5S side of the right side portion of the instep cover 1. The lace-like body is knitted using a yarn feeder different from the yarn feeder used for knitting the right side portion of the instep cover 1. The lace-like body is preferably knitted using a knitting technique such as tubular knitting using the front and back needle beds, so that a lace-like body (right side strap 4*s*R) that is stout and less likely to break can be formed. The knitting of the right side portion of the instep cover 1 is also carried out separately from the lace-like body. Upon knitting, the right side hole 4*h*R is formed through the same manner as the eyelet hole 4E of the region β. The terminating end in the wale direction of the lace-like body and the portion closer to the slit 5S in the right side portion of the instep cover 1 are then connected to complete the right side strap 4*s*R. According to such knitting procedure, the position of the right side hole 4*h*R in the length direction of the instep cover 1 is between the toe side connecting portion and the heel side connecting portion of the lace-like body configuring the right side strap 4*s*R.

The left side hole 4*h*L and the left side strap 4*s*L are formed in the left side portion of the instep cover 1 through a manner similar to the right side portion of the instep cover 1. As a result, the position of the left side hole 4*h*L in the length direction of the instep cover 1 is between the toe side connecting portion and the heel side connecting portion of the lace-like body configuring the left side strap 4*s*L.

Hereinafter, the knitting of the instep cover 1, and the knitting of the first holding unit $4U_1$ and the second holding unit $4U_2$ described above are repeated to form a desired number of holding units 4 in the instep cover 1.

In the region δ, the knitting width of the left side portion and the right side portion of the instep cover 1 is appropriately increased and reduced to complete the right side portion and the left side portion of the instep cover 1. The knitting width of the right side portion and the left side portion is gradually reduced on the heel side of the body section 1B in view of the shape of the heel cover section 1H knitted after the body section 1B.

Following the knitting of the body section 1B, a set up section to become the lower end of the heel cover section 1H is knitted between a terminating stitch row of the left side portion and a terminating stitch row of the right side portion in the longitudinal direction of the needle beds. Then, knitting of a stitch row to become the heel cover section 1H following the wale direction of the set up section of the heel cover section 1H, and overlapping of the stitch on one end side and the stitch on the other end side in the knitting width direction of the stitch row with the stitch of the terminating stitch row of the left side portion and the stitch of the terminating stitch row of the right side portion, respectively, are repeated to complete the heel cover section 1H. When connecting the heel cover section 1H and the body section 1B, the stitches of the body section 1B may be moved toward the heel cover section 1H side to overlap the stitches of the sections 1B, 1H. The stitch row of the heel cover section 1H is knitted following the wale direction of the double stitches to fix the double stitches, whereby the heel cover section 1H and the body section 1B are connected.

The heel cover section 1H may have a symmetrical shape, or may have an asymmetrical shape in accordance with the shape of the right and left feet. The knitting yarn for knitting the heel cover section 1H may be the same as, or may be different from the knitting yarn for knitting the body section 1B.

The end in the knitting width direction of the heel cover section 1H and the end in the wale direction of the body section 1B are connected by following the procedure described above. Thus, the heel cover section 1H and the body section 1B support each other, and the instep cover 1 is retained in a three-dimensional shape. The stitches of the body section 1B of the instep cover 1 knitted following such procedure are faced toward the heel, and the stitches of the heel cover section 1H are faced toward the lower side of the shoe upper 100.

In the procedure described above, the entire instep cover 1 is configured with a thick knitting pattern knitted using the front and back needle beds. The instep cover 1 that is stout and less likely to lose shape can be obtained and the durability of the shoe upper 100 (shoe) can be enhanced by configuring the instep cover 1 of the shoe, which is subjected to load during usage, with a thick knitting pattern.

When integrally knitting the sole cover 2 with the instep cover 1, the sole cover 2 is to be knitted following the lower end (upper end in the plane of drawing) of the heel cover section 1H of FIG. 3. In this case, the sole cover 2, on which the weight of the wearer acts, can be made stout by knitting the sole cover 2 using a knitting yarn excelling in strength more than the knitting yarn used for the knitting of the instep cover 1.

<<Other Knitting Methods>>

In the knitting method shown in FIG. 3, knitting is carried out with the right side portion and the left side portion of the instep cover 1 lined side by side in the longitudinal direction of the needle beds. On the contrary, the right side portion of the instep cover 1 may be knitted with one needle bed of the flat knitting machine, and the left side portion of the instep cover 1 may be knitted with the other needle bed. In this case as well, the holding units $4U_1$, $4U_2$ configuring the shoelace holding section 4 can be knitted through a procedure similar to the knitting procedure described with reference to FIG. 3.

The direction of the knitting is not particularly limited. A half gauge knitting and the like may be used to have the instep cover 1 as the thick knitting pattern.

Second Embodiment

As shown in FIG. 2, in the first embodiment, the intermediate portion of the left side strap 4*s*L is passed through the right side hole 4*h*R, and the intermediate portion of the right side strap 4*s*R is passed through the left side hole 4*h*L. On the contrary, the position of the hole to pass the strap 4*s*R, 4*s*L may be changed.

For example, the intermediate portion of the right side strap 4*s*R may be passed through the right side hole 4*h*R, and the intermediate portion of the left side strap 4*s*L may be passed through the left side hole 4*h*L. That is, the right side hole 4*h*R and the right side strap 4*s*R form the holding unit for forming the right side lace passing hole, and the left side hole 4*h*L and the left side strap 4*s*L form the holding unit for forming the left side lace passing hole. In this case, the length of each strap 4*s*R, 4*s*L may be made shorter than that in the configuration of the first embodiment.

In addition, the intermediate portion of each strap 4*s*R, 4*s*L may be passed through the hole 4*h*L, 4*h*R (or eyelet hole 4E) shifted toward the foot insertion opening 5T side or the toe side, compared to the state shown in FIG. 2.

Third Embodiment

In the instep cover 1 of the first embodiment, the first holding unit $4U_1$ and the second holding unit $4U_2$, which form a pair, are arranged at substantially the same position in the length direction of the shoe upper 100. On the contrary, the holding units $4U_1$, $4U_2$ may be arranged at positions shifted in the length direction of the shoe upper 100. In this case, the instep cover 1 in which the left side lace passing hole and the right side lace passing hole are arranged in a zigzag manner is obtained.

Fourth Embodiment

The instep cover 1 in which only the first holding unit $4U_1$ (second holding unit $4U_2$) is arranged, and the eyelet hole corresponding to the lace passing hole of the first holding unit 4$U_1$ (second holding unit 4$U_2$) is arranged may be adopted. In this case, the instep cover 1 in which the lace passing holes are lined on one side and the eyelet holes are lined on the other side with the slit 5S in between is obtained.

DESCRIPTION OF SYMBOLS

100 shoe upper
1 instep cover
1B body section
1H heel cover section
11 slit edge region
11T tongue
11R right side edge region
11L left side edge region
2 sole cover
3 shoelace
4 shoelace holding section
4U holding unit
4*h* hole
4*s* strap
4$U_1$ first holding unit
4*h*R right side hole
4*s*L left side strap
4$U_2$ second holding unit
4*h*L left side hole
4*s*R right side strap
4C tube portion
4E eyelet hole
5T foot insertion opening
5S slit

The invention claimed is:

1. An instep cover that covers a portion on an instep side of a wearer of a shoe upper configuring a shoe, the instep cover comprising a slit extending from a foot insertion opening for the wearer to insert a foot toward a toe, and a shoelace holding section that holds a shoelace for adjusting a spacing of the slit, wherein the shoelace holding section includes a holding unit comprising a hole formed in a slit edge region including a rim of the slit, and an annular strap formed by connecting a first end and a second end of a lace-like body to the same side of the slit edge region, wherein said annular strap traverses the slit at the shoelace holding section and has a length capable of being pulled out from the hole when an intermediate portion of the lace-like body is brought to a position of the hole after traversing the slit, wherein with a portion on a right side of a center line that divides the slit to right and left being a right side edge region and a portion on a left side being a left side edge region in the slit edge region of the instep cover, the shoelace holding section includes, a first holding unit configured by a right side hole formed in the right side edge region and a left side strap connecting to the left side edge region, and a second holding unit configured by a left side hole formed in the left side edge region and a right side strap connecting to the right side edge region and used as a pair with the first holding unit, wherein said first holding unit traverses the slit from left to right with a part of the left side strap capable of being pulled through the right side hole and said second holding unit traverses the slit from right to left with a part of the right side strap capable of being pulled through the left side hole;

a position of the right side hole in a length direction of the instep cover is between a toe side connecting portion and a heel side connecting portion of the lace-like body configuring the right side strap; and a position of the left side hole in the length direction of the instep cover is between a toe side connecting portion and a heel side connecting portion of the lace-like body configuring the left side strap.

2. The instep cover according to claim 1, wherein said shoelace holding section further comprises a tube portion at a cut end of the slit, a plurality of eyelet holes, and a plurality of holding units.

3. The instep cover according to claim 2, wherein said instep cover has a right side edge region on a right side of a center line that divides the slit into right and left and a left side edge region on a left side of said center line in the slit edge region of the instep cover, and wherein said instep cover comprises four sets of holding units on the right and left side regions respectively.

4. The instep cover according to claim 1, wherein the length of the annular strap capable of being pulled out from the hole when an intermediate portion of the lace-like body is brought to a position of the hole after traversing the slit, forms a shoelace passing hole.

5. The instep cover according to claim 1, wherein said holding unit comprises a first and a second annular strap attached to opposite sides of the slit edge region, wherein said first annular strap has a length capable of being pulled out from a hole positioned near the first and second ends of said second annular strap and said second annular strap has a length capable of being pulled out from a hole positioned near the first and second ends of said first annular strap.

6. The instep cover according to claim 5, wherein said first annular strap is attached to the left side of the slit edge region and has a length capable of being pulled out from a hole in the right side of the slit edge region and said second annular strap is attached to the right side of the slit edge region and has a length capable of being pulled out from a hole in the left side of the slit edge region.

7. The instep cover according to claim 1, wherein the hole and the annular strap are integrally formed in the instep cover.

8. The instep cover according to claim 1, wherein said instep cover is a seamless knitted fabric.

9. The instep cover according to claim 1, wherein said shoelace holding section evenly distributes any tightening force caused by said shoelace.

10. The instep cover according to claim 1, wherein said shoelace holding section includes a first holding unit and a second holding unit used as a pair with the first holding unit.

11. The instep cover according to claim 1, wherein said annular strap traverses the slit at the side of the instep cover and is used as a pair with a hole on the other side of the slit edge region.

12. A shoe upper comprising the instep cover according to claim 1, a sole cover that covers a sole of the wearer, and a shoelace for adjusting a spacing of the slit formed in the instep cover; wherein an intermediate portion of the left and right side straps is passed through the left or right side hole while being folded in half, and the shoelace is held in a state passed through a lace passing hole formed by the intermediate portion pulled out from the hole, wherein the right side strap is passed through the left side hole and the left side strap is passed through the right side hole.

13. The shoe upper according to claim 12, wherein both the shoelace and the left and right side straps traverse the slit.

* * * * *